United States Patent [19]

Jerman

[11] Patent Number: 4,469,278

[45] Date of Patent: Sep. 4, 1984

[54] RAIL FASTENING SYSTEM FOR USE WITH SHOULDER FITTED CONCRETE TIES

[76] Inventor: Daniel L. Jerman, 4 Beacon Hill Dr., Phoenixville, Pa. 19460

[21] Appl. No.: 404,857

[22] Filed: Aug. 3, 1982

[51] Int. Cl.[3] ..... E01B 9/30

[52] U.S. Cl. ..... 238/349; 238/338

[58] Field of Search ..... 238/310, 338, 349, 351

[56] References Cited

U.S. PATENT DOCUMENTS

| | | | |
|---|---|---|---|
| 3,749,310 | 7/1973 | Borup et al. | 238/349 |
| 4,074,860 | 2/1978 | Rex | 238/351 X |
| 4,254,909 | 3/1981 | Rex | 238/349 X |

FOREIGN PATENT DOCUMENTS

| | | | |
|---|---|---|---|
| 869385 | 5/1961 | United Kingdom | 238/349 |
| 2006308 | 5/1979 | United Kingdom | 238/349 |

*Primary Examiner*—Randolph Reese

*Attorney, Agent, or Firm*—Woodcock Washburn Kurtz Mackiewicz & Norris

[57] ABSTRACT

A novel hold down apparatus for holding railway rail assemblies to concrete ties fitted with Pandrol-type shoulders is disclosed. The apparatus generally comprises a rail clip seated on the upper surface of the Pandrol-like shoulder. The tip of this clip engages a portion of the rail assembly. A generally U-shaped locking pin clamps the rail clip to the shoulder and biases the clip tip toward the rail assembly to create the desired hold down pressure. This configuration is particularly adapted for use in holding down railway rail assemblies in the vicinity of joints where hold down clearance is minimal. The disclosed apparatus also facilitates the use of novel, high resiliency rail pads. The disclosed fastening system is intended to extend the useful life of concrete ties which are now subject to severe cracking due to existing high impact couplings between the rail and concrete ties.

14 Claims, 4 Drawing Figures

RAIL FASTENING SYSTEM FOR USE WITH SHOULDER FITTED CONCRETE TIES

BACKGROUND OF THE INVENTION

There are currently over a million concrete ties in track of the railroads in North America using Pandrol-type fastening systems. Such systems typically comprise an embedded Pandrol-like shoulder, Pandrol-type fastener clips and various types of pads and insulators. Typically, the Pandrol-like shoulders are ductal iron elements which are embedded about 5½ inches (14 cm) into the body of the concrete tie and protrude about 1½ inches (4 cm) above the surface of the tie to define a 0.938 inch (2.38 cm) diameter cylindrical bore which is parallel to the axis of the rail. This shoulder further defines a ledge on the side of the bore opposite the rail which is about 0.865 inches (2.19 cm) above the rail surface, and is adapted to receive a rail clip as described hereinafter. Rails are installed between the iron shoulders by first placing molded plastic rail pads between the shoulders, which pads are approximately 7½ inches (19 cm) long and about 7¾ inches (19.7 cm) wide, having two 9/16 inch (1.4 cm) cut-outs on either side which are about 3 1/16 inches (8 cm) in length. These cut-outs permit the pads to be fitted between opposing shoulders. These pads are typically 0.2 inches ±0.02 inches, or about 3/16 inch (4.76 mm), thick and for the most part are extremely stiff, being made typically of ethylene vinyl acetate copolymer resin such as Dupont grade EVA 3130.

Once these pads are in place a rail is put into position between the shoulders. Rail insulators are then placed adjacent to the shoulders and over and against adjacent surfaces of the rail base. Typically these insulators are about 0.394 inches (1 cm) thick, and comprise bosses which extend for a short distance along the side faces of their adjacent shoulders to maintain their position. Anchoring of the rail is accomplished using a rail clip which is typically a short length of ⅞ inch (2.2 cm) heat treated steel rod which has been formed so that each of the ends thereof are parallel and spaced apart from each other. One of these ends is forced into the cylindrical bore of the iron shoulder, while the other seats against the aforementioned ledge formed on that shoulder. The portion of the clip disposed between these two ends is configured so that it contacts the top surface of the rail insulator and presses the rail insulator, rail base, and rail pad against the concrete tie.

While the aforementioned system has experienced considerable commercial success in this country, it has been found that severe cracking of the concrete ties due to high impact coupling between the rail and the concrete tie often results, particularly when the road bed is used for high speed travel. This high impact coupling is caused by wheel and/or rail surface irregularities, and is aggravated by deterioration of insulators and pads in service. Although it would appear that the provision of thicker pads might remedy the problem, the geometry of the rail shoulder and Pandrol-like fastener practically insures that alternate or substitute thicknesses cannot be use. Further due to the combination of torque and bending stresses inherent in the configuration of the clip, deflection of the clip in service produces an eccentric bending moment. This torque hysteresis causes the clip to be sensitive to small rail/wheel anomalies and work out of the shoulder.

Deterioration of concrete ties has been found to be particularly severe in the vicinity of insulated rail joints. At insulated rail joints, a head bond block of plastic impregnated paper is disposed between two adjacent rail ends. This head block interrupts the monolithic nature of the rail and causes a different flexure than is normally encountered in continuous rail. The head bond block also causes a surface anomaly between the rails, since the ends of these rails are slightly spaced apart by the head bond block. The sides of adjacent rail ends located at an insulated joint are typically fitted with bonded joint bars which are wrapped with insulation, and therefore are not in electrical contact with the rails. These bonded joint bars are normally bonded and bolted to both sides of the rails using epoxies and heavy duty nuts and bolts which are insulated from the rail using full length insulating bushings.

In present Pandrol-type systems, "J" clips (with insulating caps) are used to hold down rails in the vicinity of the rail joints, including insulated rail joints. Unfortunately, the configuration of these "J" clips is such that they cannot be made to bear on the bonded joint bar if a joint bar bolt is located adjacent to the Pandol-like shoulder. Accordingly, it may be necessary to omit certain hold down clips in the vicinity of certain rail joints. Deterioration of concrete ties in the vicinity of such rail joints is accordingly accelerated due to the lack of a hold down system which is completely effective in the rail joint region, particularly in regions of insulated rail joints.

SUMMARY OF THE INVENTION

The present invention provides a novel system which is suitable for retrofitting road beds without altering existing Pandrol-like shoulders or concrete ties. This system overcomes many of the deficiencies of prior art techniques for fastening rails to Pandrol-like shoulders and ties. The present invention provides a hold down apparatus comprising a spring steel rail clip which is seated on the upper surface of the Pandrol-like shoulder, and a U-shaped locking pin, one of the legs of which is disposed within the shoulder bore, and the other leg of which clamps the rail clip to the Pandrol-like shoulder and biases the tip portion of the clip toward the rail assembly to provide the desired hold down pressure. The resultant system is easily assembled, but is vandal resistant, requiring special techniques to effect its convenient disassembly.

The preferred embodiment hold down apparatus comprises a biasing means for retaining the locking pin at a preselected degree of rotation with respect to the bore of the shoulder, to thereby establish a preselected degree of rail clip bias towards the rail assembly. This biasing means comprises a spur located on the upper surface of the rail clip. In the preferred embodiment, each of the legs of the locking pin are also provided with bevelled flanges which retain the locking pin in the bore of the shoulder and which insure that the rail clip cannot slide laterally with respect thereto.

The railway rail assembly used with the hold down apparatus of this invention may comprise conventional insulators and railway rails disposed over conventional rail pads. It is preferred, however, to utilize extra-thick rail pads having zig zag grooves staggered on the rail pad faces to provide extra resiliency between the rail and underlying concrete tie.

In an alternate embodiment of the present invention a short rail clip is provided which is adapted to bear upon the upper and side surfaces of a bonded joint bar. This rail clip is configured such that it may be used regardless of the position of the joint bar bolts, and may even be disposed between an upper surface of the bonded joint bar and a joint bar nut. When this embodiment is to be used in the vicinity of an insulated joint, an insulating cap is used to insulate the rail clip from the rail assembly.

Accordingly, a primary object of the present invention is the provision of an improved rail fastening system for use with Pandrol-like shoulder fitted concrete ties.

Another object of the present invention is the provision of a Pandrol-type hold down system which facilitates the use of extra thick, high resiliency rail pads.

These and other objects of the present invention will become apparent from the following more detailed description of the invention.

BRIEF DESCRIPTION OF THE DRAWINGS

in FIG. 4 the tip of the rail clip is shown bearing on the side and upper surfaces of a joint bar in a region near a joint bar nut.

DESCRIPTION OF THE PREFERRED EMBODIMENTS

Although specific forms and examples of the present invention are described hereinafter, those of ordinary skill in the art will recognize that various alterations may be made to the materials and methods described hereinafter without departing from the scope of the present invention, which is defined more particularly in the appended claims.

Figure 1:
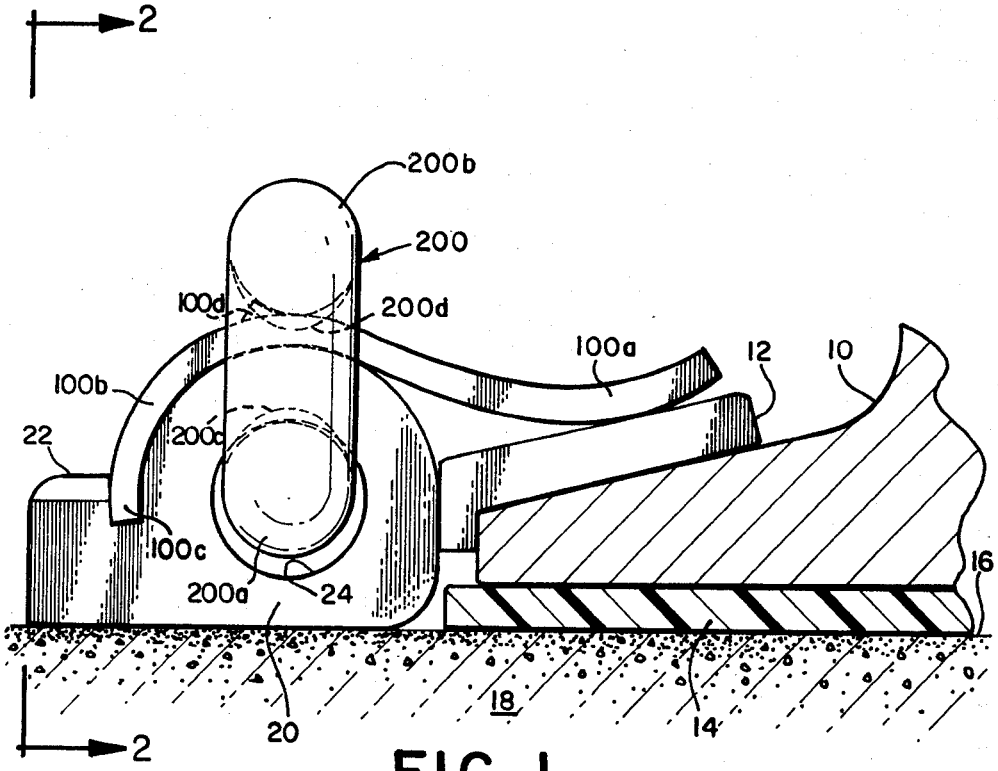
FIG. 1 is a side view of the preferred embodiment hold down apparatus shown in combination with a Pandrol-type rail shoulder, a cross section of a portion of a concrete tie, and a cross section of a portion of a railroad rail.

The preferred hold down apparatus of the present invention is intended for use in fastening a railway rail assembly to concrete ties fitted with Pandrol-like shoulders. In FIG. 1 a portion of a typical rail assembly comprising a rail 10, rail insulator 12, and rail pad 14 are illustrated. This rail assembly rests on a concrete tie surface 16 of concrete tie 18. Concrete tie 18 is shown fitted with a Pandrol-like shoulder designated generally 20 which has a bore 24 defined therethrough which is parallel to the axis of rail 10. The Pandrol-like shoulder further defines a ledge 22 and a rounded top surface disposed generally above bore 24.

The preferred embodiment of the present invention comprises a rail clip designated generally 100 and a locking pin designated generally 200. The rail clip is made of spring steel (such as heat treated SAE 516 steel having a Rockwell hardness of 40–44 Rockwell "C") generally in the form of an S-curve which engages the rail base through rail insulator 12 at its tip 100*a*. Although the S-shape of this clip is preferred, other shapes or curvatures of this clip can also be used to bridge from the Pandrol-like shoulder to the rail insulator. Clip 100 mates with the radius of the shoulder through its base portion 100*b* and terminates in ears 100*c* which engage the edges of ledge 22 of shoulder 20. The engagement of the sides of the ledge or boss at the rear of the shoulder prevents slewing or lateral movement of the clip.

Figure 2:
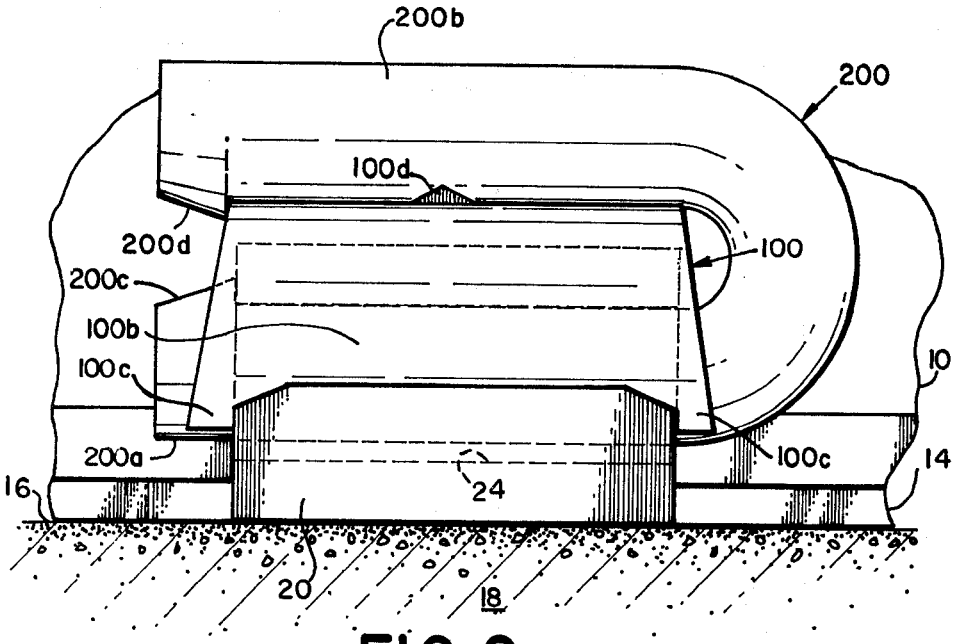
FIG. 2 is an end view of the preferred embodiment hold down apparatus of FIG. 1, taken in accordance with the lines and arrows 2—2 in FIG. 1.

As shown in FIG. 2, the locking pin 200 generally comprises two legs, bottom leg 200*a*, which is disposed in and through bore 24 of the shoulder, and top leg 200*b* which extends over the top surface of rail clip 100, and which clamps rail clip 100 to the top surface f he Pandrol-like shoulder.

As seen particularly in FIG. 1, the amount of force applied through rail insulator 12 to the base of rail 10 depends in part upon the rotational orientation of the locking pin 200 within the bore of the Pandrol-like shoulder 200. It will be noted that by orienting the pin 200 so that the top leg 200*b* is to the right of vertical as viewed in FIG. 1, a greater biasing of the tip 100*a* of rail clip 100 will result. Conversely, if locking pin leg 200*b* is located to the left of vertical as seen in FIG. 1, greater flexure and less biasing of rail clip tip 100*a* against rail 10 will result. For this reason, the preferred embodiment device comprises biasing means for retaining the locking pin at a reselected degree of rotation with respect to the bore of the shoulder, to thereby establish a preselected degree of rail clip bias toward the rail assembly. In the preferred embodiment, this has been ensured by configuring rail clip 100 to engage at least a portion of ledge 22, and by providing a spur means disposed on the rail clip for engaging and limiting the rotation of the locking pin, and particularly locking pin leg 200*b*. The spur means comprises a spur 100*d* which is punched in the rail clip stock and which acts to retain the locking pin 200 at its desired degree of rotation.

It is desirable to insure that the components of the preferred hold down apparatus will not work loose during service and cannot be easily removed by vandals. Accordingly, the locking pin 200 is provided with a bore retaining means for retaining leg 200*a* of the pin in the bore of the shoulder under operating conditions. The bore retaining means comprises a bevelled flange 200*c* at the tip of leg 200*a*. When the locking clip is properly seated in the rail shoulder, the flange will snap into place and, unless separated from the opposing leg of the locking clip, will engage a portion of the Pandrol-like shoulder and thus resist removal.

Locking pin 200 similarly comprises a clip retaining means for at least retaining the lateral position of the clip relative to the upper surface of the Pandrol-like shoulder. This clip retaining means also comprises a bevelled flange 200*d* which engages an edge of the clip 100 to prevent disassembly of the apparatus until the legs of the locking pin are separated to provide clearance for these bevelled flanges.

Separation of the legs of the locking pin should be accomplished using a lever which separates the legs of the locking pin, whereupon the locking pin may be pushed and/or pulled out of its assembled position. At the present time, it is believed that removal techniques requiring striking of the locking pin should be avoided in order to prevent damage to the relatively fragile underlying concrete tie.

As seen in FIG. 2, it is preferred to configure the rail clip so that it tapers from its widest point at ears 100*c* to a narrower width at tip 100*a*. The width of the rail clip at tip 100*a* will determine the pressure per unit area to be applied to rail insulator 12.

Figure 3:
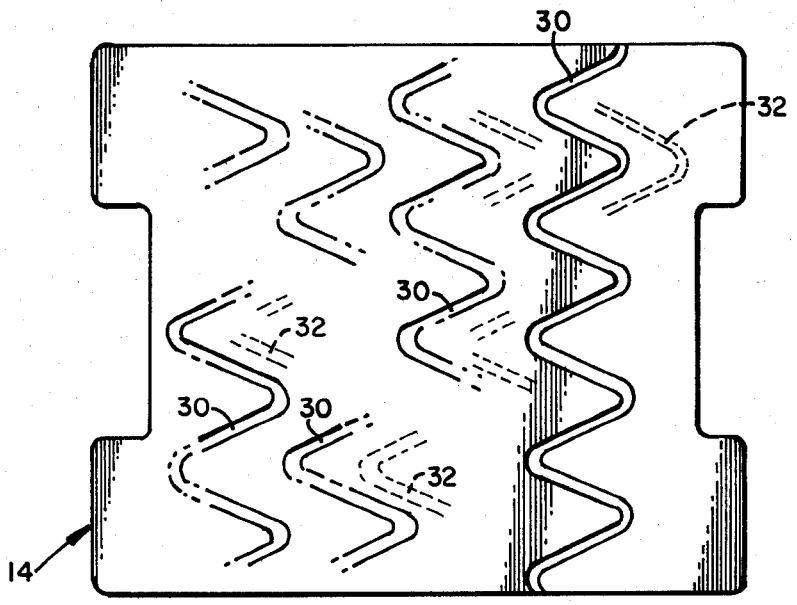
FIG. 3 is a top view of a preferred embodiment rail pad for use with the hold down apparatus of FIG. 1.

One of the advantages of the above-described hold down apparatus is its ability to accommodate the use of substantially thicker rail pads. Rail pad 14 in FIG. 1 is one such rail pad. This rail pad, which has been fitted with a retainer 15, is further illustrated in FIG. 3. The rail pad, which is about 8–10 mm thick, preferably 9 mm thick, is composed of an elastomeric material having a resilience of about 100 kN/mm. In the preferred embodiment, the rail pad defines a number of zig zag grooves in the surfaces thereof, which grooves are about 4–5 mm deep. These zig zags, which are spaced across both faces of the pads and staggered with respect to the position of the grooves on the opposite side of the pad, exhibit an increased resiliency and sliding frictional resistance with respect to contiguous rail and concrete tie surfaces. The use of this pad achieves a dynamic stiffness of 500,000 to 1,000,000 pounds per inch deflection, and thereby permits greater attenuation of impact energy from the interface of equipment and rail.

Figure 4:
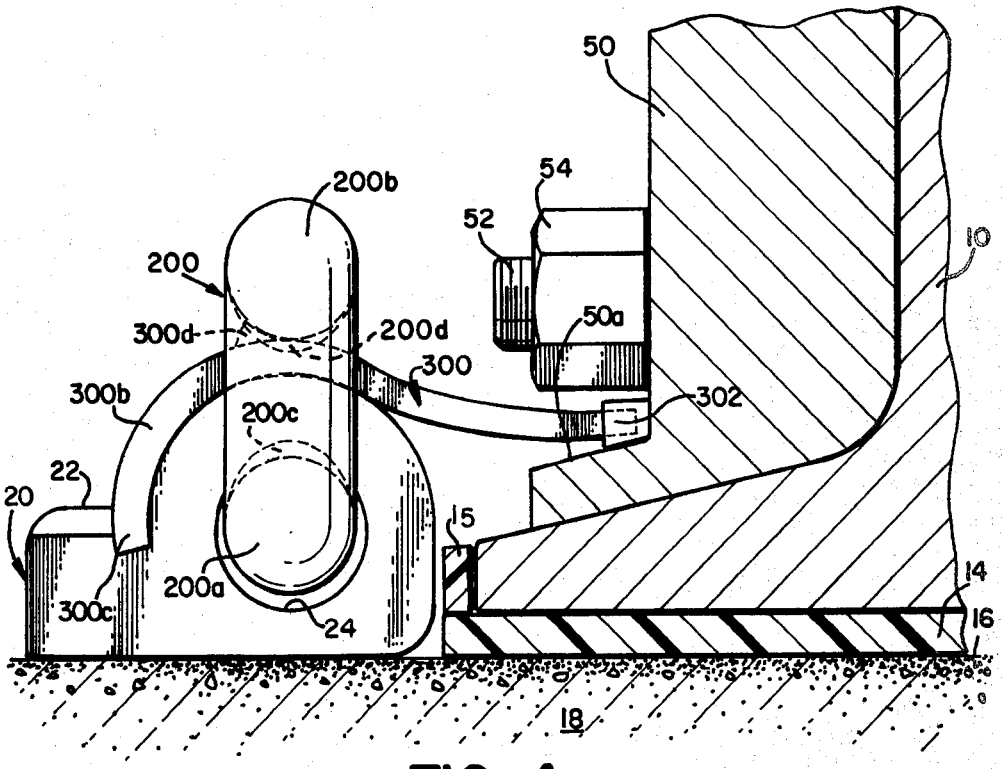
FIG. 4 is a view similar to FIG. 1 but showing an alternate embodiment hold down apparatus for use in the vicinity of a railway rail joint.

In FIG. 4 an alternate embodiment hold down apparatus is illustrated which is intended for use in a rail joint region. In this region a bonded joint bar 50 is bolted to the side and base of rail 10 by bolts such as bolt 52 and nut 54. As seen in FIG. 4 the clearance between nut 54 and the upper surface 50*a* of the bonded joint bar is minimal. Nonetheless, a short, alternate embodiment rail clip 300 easily fits in the clearance provided, and suitably anchors the rail assembly in the vicinity of the rail joint by bearing upon the upper and side surfaces of joint bar 50 to retain the rail assembly in position. In certain instances it may be advantageous to insulate the hold down apparatus from the rail joint. Accordingly, the tip of rail clip 300 may be provided with an insulating cap 302 for insulating the rail clip tip from the joint bar. In the preferred embodiment, this insulating cap is composed of a suitable insulating plastic of sufficient strength and durability to withstand prolonged operating conditions. In this embodiment, a soft elastomer rail pad bonded to a rectangular vinyl acetate copolymer retainer 15 should be used to further stabilize the rail assembly between the Pandrol-like shoulders. As seen in FIG. 4, this alternate embodiment hold down apparatus is otherwise similar to the embodiment described in connection with FIGS. 1 and 2, and has been so labelled with corresponding "300 series" numbers.

As seen from the above a simple reliable hold down apparatus and improved rail assembly are disclosed which should extend the life of existing concrete tie road beds. The disclosed system is effective to fasten the rail assembly to concrete ties in a manner which resists the tendency of the rail assembly to rotate due to centrifugal force on the wheel-rail interface, or from normal "hunting" of trucks in service.

What is claimed:

1. Hold down apparatus for holding railway rail assembly to concrete ties fitted with Pandrol-like shoulders, said shoulders comprising an upstanding portion having rail-parallel bore defined therethrough, having a curved upper surface over said bore, and having a ledge adjacent to said bore on the side reote from said rail, said apparatus comprising:

(a) a rail clip engaging said upper surface of said upstanding portion and a portion of said rail assembly, and (b) locking pin means for connecting said rail clip means to said shoulder and for biasing a portion of said clip toward said rail assembly to apply hold down pressure to said rail assembly said locking pin means comprising a generally U-shaped locking pin, one of the legs of said locking pin being configured for insertion into said bore of said shoulder, said locking pin further comprising clip retaining means at least for retaining the lateral position of said clip relative to said surface of said shoulder, said clip retaining means further comprising a bevelled flange defined on the clip engaging leg of said locking clip.

2. The apparatus of claim 1 wherein said apparatus comprises biasing means for retaining said locking pin at a preselected degree of rotation with respect to the bore of said shoulder, to thereby establish a preselected degree of rail clip bias toward said rail assembly.

3. The apparatus of claim 2 wherein said rail clip engages at least a portion of said shoulder.

4. The apparatus of claim 3 wherein said biasing means comprises spur means disposed on said rail clip for limiting the rotation of said rail clip.

5. The apparatus of claim 3 wherein said clip comprises shoulder ledge engaging means for preventing lateral movement of the base of said clip relative to said ledge.

6. The apparatus of claim 5 wherein said shoulder ledge engaging means comprises ears for engaging portions of the sides of said ledge.

7. The apparatus of claim 1 wherein said locking pin further comprises bore retaining means at least for retaining a leg of said pin in said bore of said shoulder.

8. The apparatus of claim 7 wherein said retaining means comprises a bevelled flange defined on the bore engaging leg of said locking clip.

9. The apparatus of claim 1 wherein said rail clip is a generally S-shaped spring.

10. The apparatus of claim 9 wherein said clip tapers towards said rail assembly.

11. The apparatus of claim 1 wherein said railway rail assembly comprises a joint having at least one bonded joint bar bolted to the rails in the region of the joint, and wherein a tip of the rail clip bears on an upper surface of said bonded joint bar.

12. The apparatus of claim 11 wherein said tip is disposed between said upper surface of said joint bar and a portion of a joint bar bolt.

13. The apparatus of claim 11 wherein said tip comprises an insulating cap for insulating said tip from said joint bar.

14. The apparatus of claim 1 wherein said rail assembly comprises a rail insulator disposed over an upper surface of the rail base, said clip being disposed to bear on said rail through said insulator.

* * * * *

UNITED STATES PATENT AND TRADEMARK OFFICE

CERTIFICATE OF CORRECTION

PATENT NO. : 4,469,278

DATED : September 4, 1984

INVENTOR(S) : DANIEL L. JERMAN

It is certified that error appears in the above-identified patent and that said Letters Patent are hereby corrected as shown below:

IN THE CLAIMS:

Claim 1, Column 5, Line 58, please delete "reote" and substitute therefor --remote--.

Signed and Sealed this

*Nineteenth* Day of *February 1985*

[SEAL]

*Attest:*

DONALD J. QUIGG

*Attesting Officer*

*Acting Commissioner of Patents and Trademarks*